US005453019A

United States Patent [19]

Garver et al.

[11] Patent Number: 5,453,019

[45] Date of Patent: Sep. 26, 1995

[54] INTERNAL/EXTERNAL ANTENNA SWITCH CONNECTOR

[75] Inventors: William J. Garver, Harrisburg; John T. Heck, Dauphin; Harold W. Kerlin, Port Royal; Donald L. Metzger, Harrisburg; Wilmer L. Sheesley, Halifax, all of Pa.

[73] Assignee: The Whitaker Corporation, Wilmington, Del.

[21] Appl. No.: 987,030

[22] Filed: Dec. 7, 1992

[51] Int. Cl.[6] ..... H01R 13/703

[52] U.S. Cl. ..... 439/188; 439/610

[58] Field of Search ..... 439/188, 217, 439/218, 221, 98, 607, 610, 693; 200/51.01–51.10

[56] References Cited

U.S. PATENT DOCUMENTS

| | | | |
|---|---|---|---|
| 3,946,390 | 3/1976 | Alexander et al. . | |
| 4,106,841 | 8/1978 | Vladic | 439/185 X |
| 4,286,335 | 8/1981 | Eichler et al. . | |
| 4,380,691 | 4/1983 | Sato . | |
| 4,514,030 | 4/1985 | Triner et al. | 439/188 X |
| 4,552,423 | 11/1985 | Swengel, Jr. . | |
| 4,666,231 | 5/1987 | Sheesley et al. . | |
| 4,798,542 | 1/1989 | Asick et al. | 439/188 X |
| 4,804,339 | 2/1989 | Cohen . | |
| 4,850,888 | 7/1989 | Denlinger et al. . | |
| 4,897,046 | 1/1990 | Tengler et al. | 439/610 X |
| 4,971,569 | 11/1990 | Gooch et al. . | |
| 5,030,122 | 7/1991 | Birch et al. . | |
| 5,064,973 | 11/1991 | Zinn et al. . | |
| 5,076,797 | 12/1991 | Moulton . | |
| 5,085,592 | 2/1992 | Sekiguchi et al. | 439/188 X |
| 5,090,915 | 2/1992 | Moulton . | |
| 5,108,300 | 4/1992 | Weber . | |
| 5,112,238 | 5/1992 | Cizin . | |
| 5,145,391 | 9/1992 | Alwine . | |
| 5,145,416 | 9/1992 | Cruise et al. . | |
| 5,147,992 | 9/1952 | Eriksen et al. . | |
| 5,160,272 | 11/1992 | Zell et al. | 439/607 X |
| 5,267,882 | 12/1993 | Davis | 439/610 X |

FOREIGN PATENT DOCUMENTS

| | | |
|---|---|---|
| 0439147A1 | 7/1991 | European Pat. Off. . |
| 4042306A1 | 12/1990 | Germany . |
| 4111049A1 | 4/1991 | Germany . |

*Primary Examiner*—Larry I. Schwartz
*Assistant Examiner*—Daniel Wittels
*Attorney, Agent, or Firm*—William B. Noll

[57] ABSTRACT

This invention relates to the field of communication equipment, such as cellular phones, but more particularly to a switch connector to allow for switching from one antenna, i.e. internal, to another, i.e. external. The switch connector comprises first and second intermatable, generally circular connector members, where the first connector member comprises a metallic shell having a dielectric insert therein, where the insert includes a central through cavity, and a pair of formed, electrical, spring contact arms arranged to electrically interconnect in a resiled condition. The second connector member comprises a metallic shell having a dielectric insert therein, where the insert includes a central through hole for receiving a single formed contact arm having a mating end supported by the insert. As the connector members are brought into mating engagement, with the respective shells in electrical contact, the end of the contact arm of the second connector member effects a disconnection of the contact arms of the first connector while electrically connecting with one of the contact arms.

8 Claims, 7 Drawing Sheets

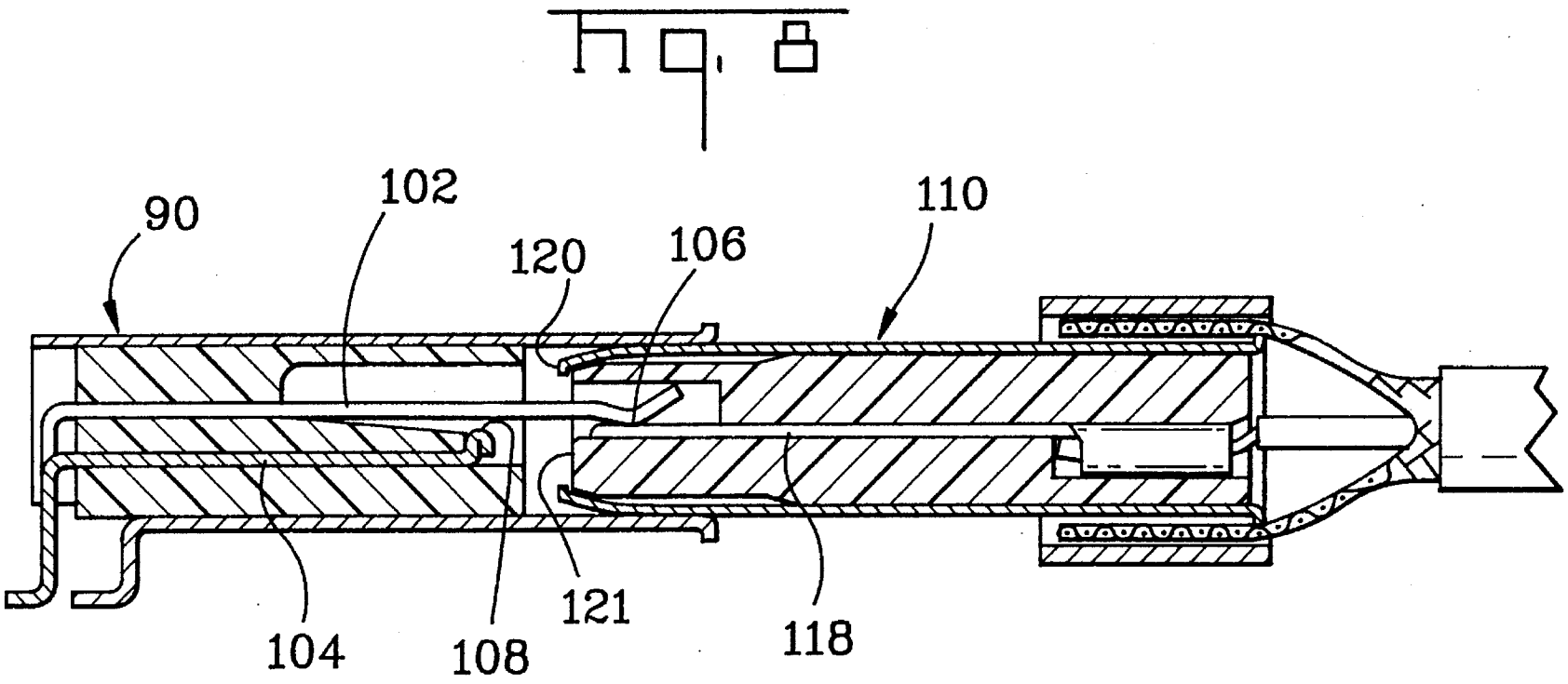
110
118
106
121
120
108
102
104
90

INTERNAL/EXTERNAL ANTENNA SWITCH CONNECTOR

BACKGROUND OF THE INVENTION

In the field of communication equipment, such as cellular phones, there is a need to provide for a pluggable connector that will allow the equipment to switch from an internal antenna to an external antenna, and back, i.e. from cradle to hand held unit.

There are many kinds of apparatus that are known which require switching from one antenna to another, and there are many types of interconnect arrangements which will switch automatically as, for example, when a portable device is inserted into a higher powered unit in a vehicle. In such a case, the portable antenna may be either inadequate or too shielded by the vehicle body for transmission and reception over longer distances. Such an arrangement is shown in U.S. Patent No. 3,946,390. In that arrangement, a coaxial connector on the end of a coaxial cable activated a conductive plunger which disconnected the internal antenna from the radio circuit and connected an external signal source from an external antenna to the radio circuit.

U.S. Patent No. 4,286,335, also relying on a plunger arrangement to disconnect one antenna, represents an improvement thereover. Briefly, the apparatus thereof is contained within an insulating housing. Mounted on this housing, preferably releasably, is a small coaxial antenna. The center conductor of the antenna contacts the resilient center conductor of a coaxial switch/connector having a conductive housing, the resilient conductor being coupled to the center conductor of a coaxial cable for bringing received signals to the radio circuitry of the apparatus. When the apparatus is inserted into an external device such as a mobile radio in a vehicle, another coaxial cable is automatically coupled to the apparatus with the cable center conductor actuating a spring-loaded plunger to disconnect the small antenna center conductor from the resilient conductor of the switch/-connector and to connect, instead, an external antenna to the apparatus circuitry.

The present invention avoids the more complex arrangements of the prior art, while providing the capability to switch from one antenna to another, and carry power and in line connection from cradle to hand held unit, for example. Additionally, by the construction hereof, a shielded low DB loss system is provided. This will become apparent in the description which follows, particularly when read in conjunction with the accompanying drawings.

BRIEF DESCRIPTION OF THE DRAWINGS

FIG. 8 is a sectional view of the assembled switch/connector of FIG. 7.

SUMMARY OF THE INVENTION

The present invention is directed to an antenna switch connector, such as may be used with a cellular phone, to provide for switching between an internal and an external antenna. The switch connector includes first and second intermatable, generally circular connector members. The first connector member comprises a metallic shell having a dielectric insert therein, where the insert includes a central through cavity, a pair of formed, electrical, spring contact arms arranged to electrically interconnect in a resiled condition. The second connector member comprises a metallic shell having a dielectric insert, where the insert includes a central through hole for receiving a single formed contact arm having a mating end supported by the insert. As the connector members are brought into mating engagement, with the respective shells in electrical contact, the end of the contact arm of the second connector member effects a disconnection of the contact arms of the first connector while electrically connecting with one of said contact arms. By this construction of the connector, there is provided a make before break connection.

DETAILED DESCRIPTION OF PREFERRED EMBODIMENTS

This invention is directed to apparatus in the field of communication equipment, such as cellular car phones, where there is a need to provide for a system containing a pluggable connector that will allow the equipment to switch from one antenna to another, such as an internal antenna to an external antenna.

Figure 1:
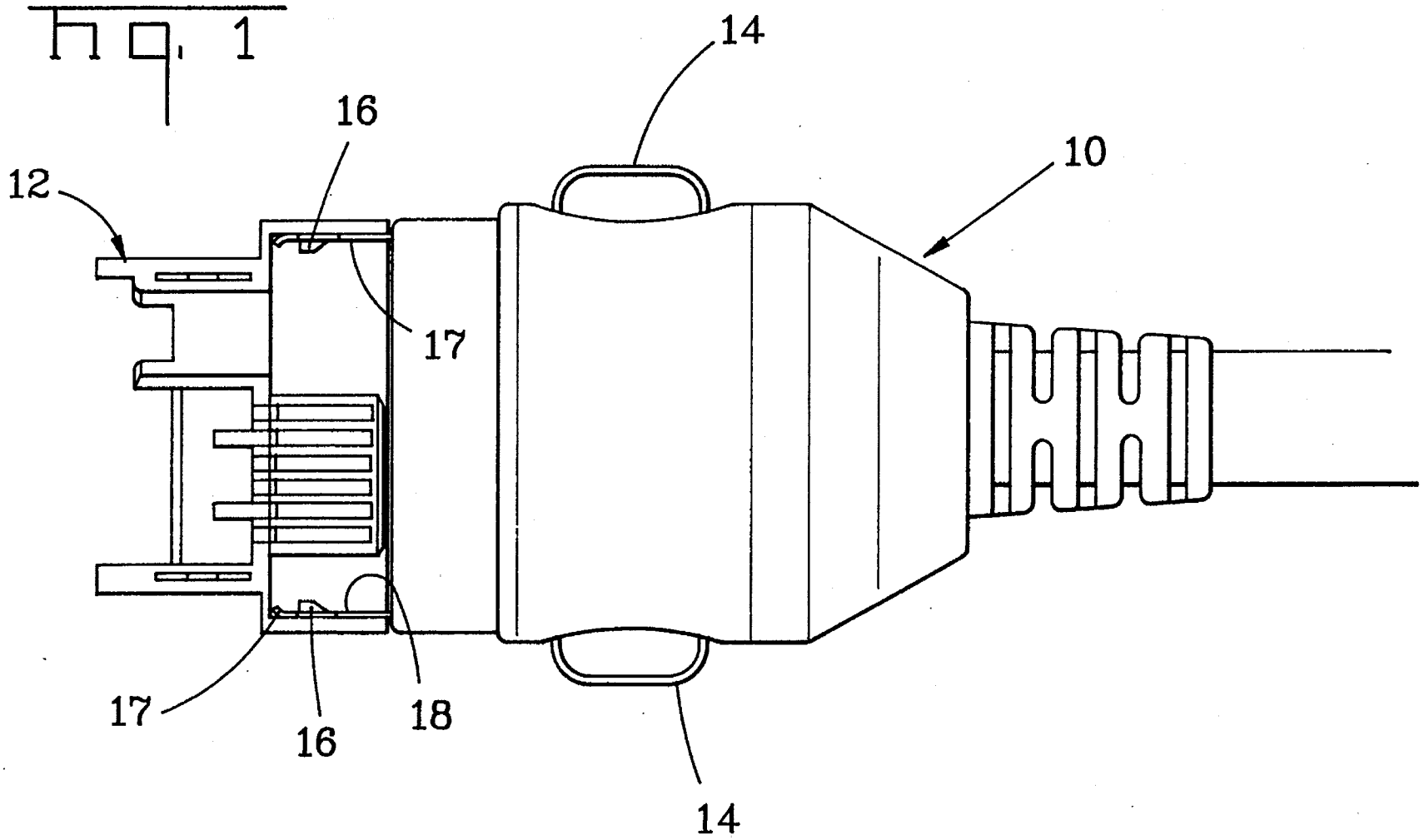
FIG. 1 is a plan view with parts removed, of an antenna connector for communication apparatus, such as a cellular phone, in which the switch/connector of this invention, to switch from an internal to external antenna, may be used.
Figure 2:
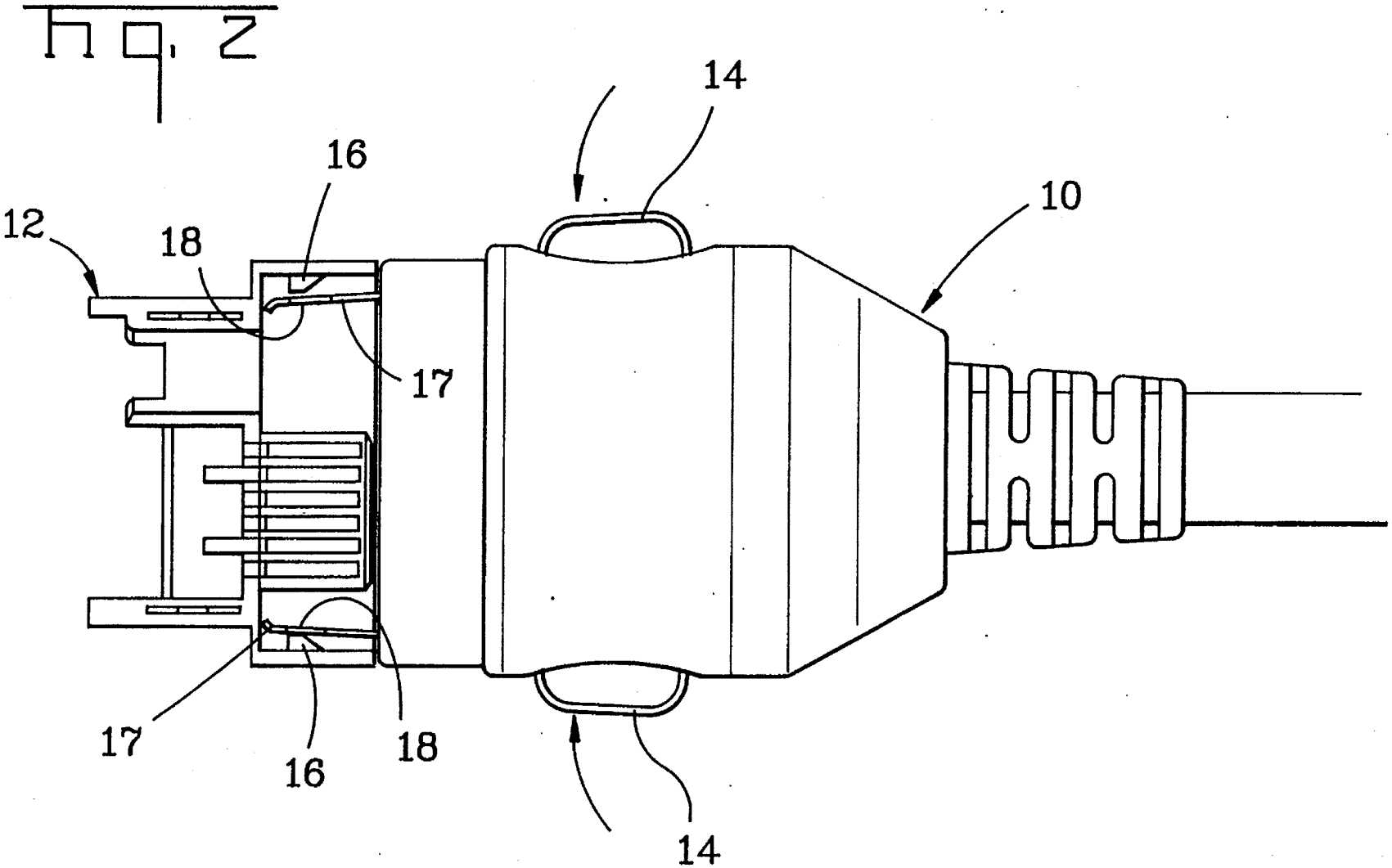
FIG. 2 is a plan view similar to FIG. 1, illustrating the connector in the position of unmating the connector housings.

FIGS. 1 and 2 are partial perspective views of the primary components or matable dielectric housing members for the type of equipment, i.e. cellular phone, that can utilize the switch connector of this invention. Briefly, connector housing 10, fixedly mounted, for example, is connected to the power, signal lines, and external antenna, such as a "black box", as known in the art. Connector housing 12, only a portion of which is represented in FIGS. 1 and 2, is the portable unit which may be readily disconnected from connector housing 10 by disengaging the latching members 14 from tabs 16. FIG. 2, specifically the direction arrows, illustrate the manner by which the respective housing members 10, 12 may be unmated. As the latching members 14 are squeezed together, spring arms 17, with slots 18 provided therein, are released from tabs 16 thereby freeing the housing members 10, 12 for unmating.

Though not illustrated in the Figure, a major component of the portable connector 12 is a planar conductive panel, such as a printed circuit board (PCB), as known in the art. Each of the connector housings 10,12, receive one of two matable connector members of the connector/switch of this invention as more fully described hereinafter.

Figure 3:
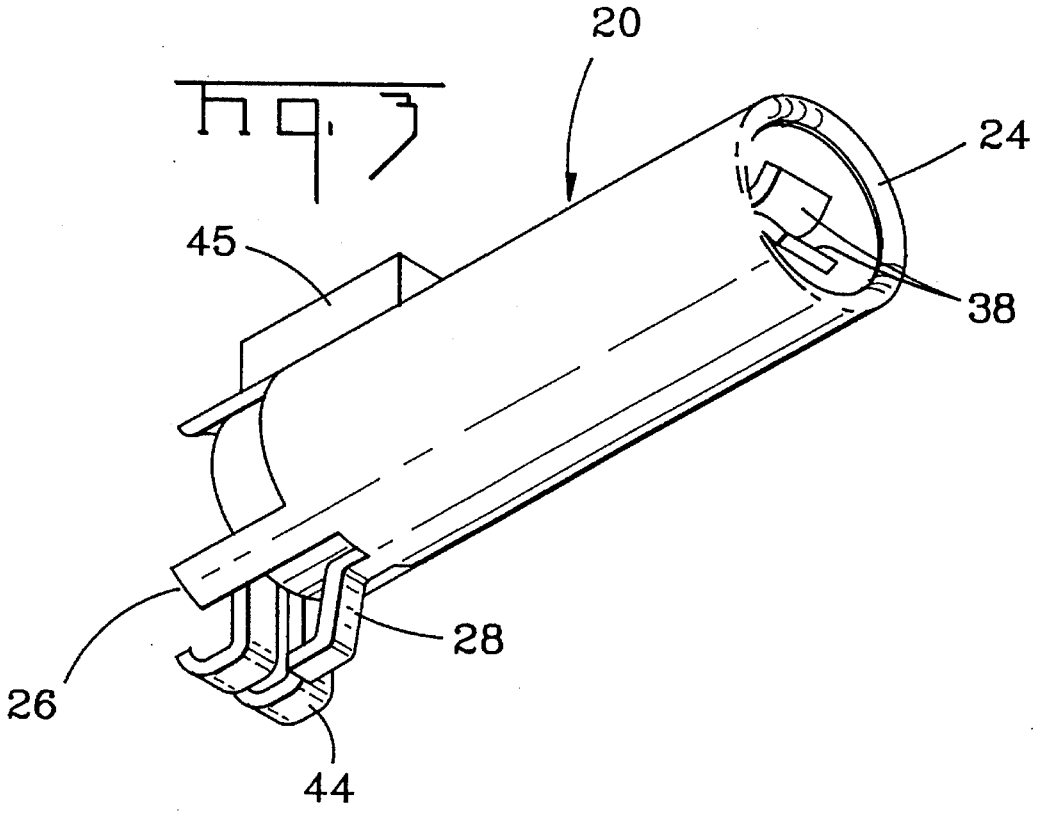
FIG. 3 is a perspective view of a first connector member secured within one of the connector housings shown in FIG. 1 and 2.
Figure 5:
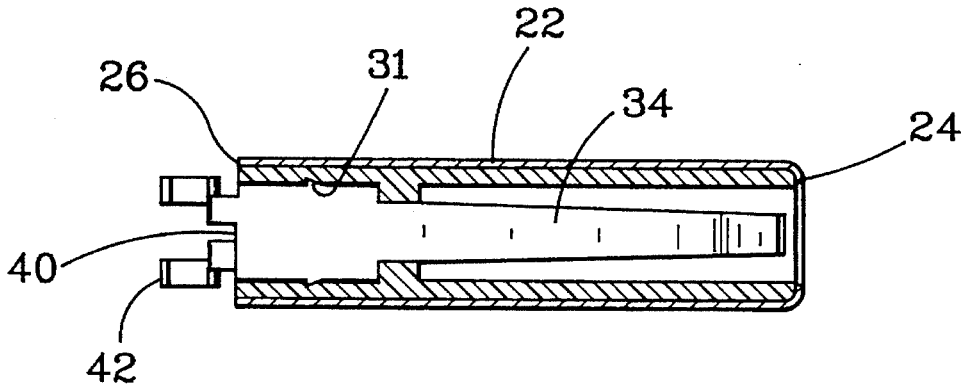
FIG. 5 is a sectional view of one of the switch/connector members of FIG. 3.
Figure 4:
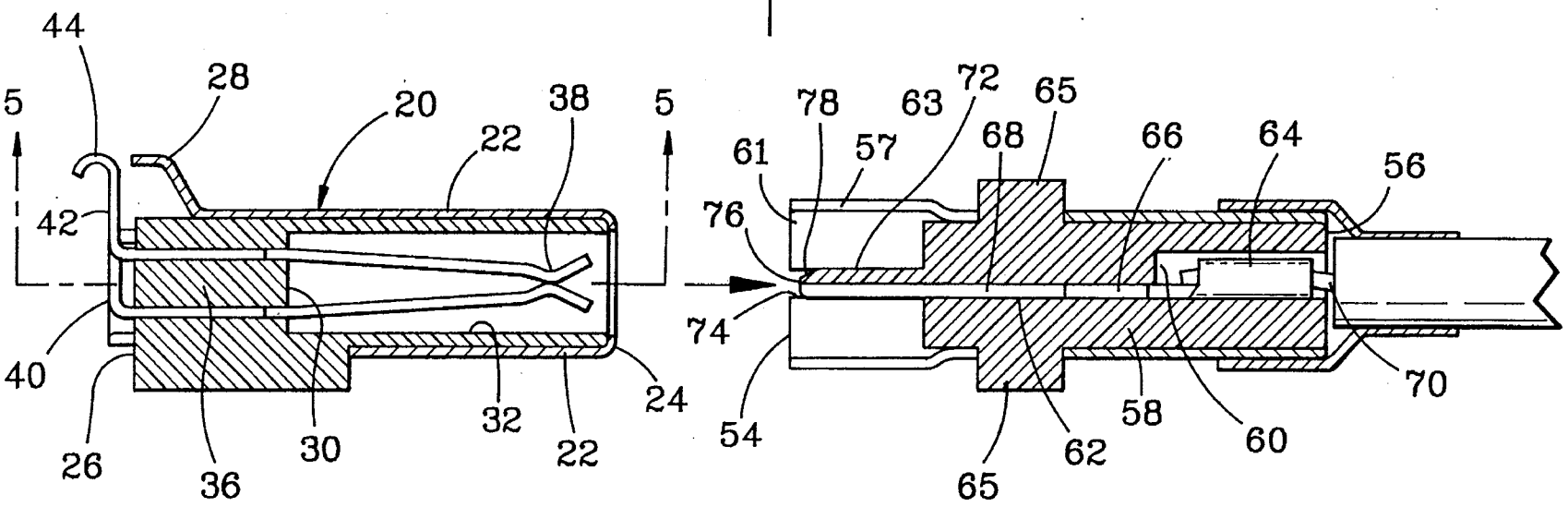
FIG. 4 is an exploded sectional view of a preferred embodiment for the switch/connector according to this invention, utilizing a make before break arrangement.

Turning now to the connector/switch of this invention, FIG. 3, and the left most component in FIG. 4, illustrates a first connector member 20 to be secured in connector housing 12. The connector member 20 comprises a metal shell 22, typically about 0.008–0.010 inches thick, extending from a mating face 24 to a terminated end 26. The latter end includes a grounding tab 28 for connection, preferably by soldering, to a grounding path of a planar conductive member, such as on a PCB. Disposed within said shell is a dielectric insert 30 containing a contact cavity 32 for receiving contact arms 34, where such contact arms are fixedly secured within the base 36 of insert 30, such as by barbs 31 digging into the insert wall, see FIG. 5. The contact member 34 consists of a pair of electrically conductive, spring metal arms having opposed arcuate-shaped ends 38 to provide a contact point therebetween. Each such arm, at its opposite end 40, is provided with a tab 42, where the lowermost portion 44 thereof lies in a plane with the grounding tab 28. By this arrangement, each such tab may be easily soldered to a corresponding conductive path of a PCB. Finally, a polarizing projection 45 is provided for aligning and securing same within connector housing 12.

Figure 6:
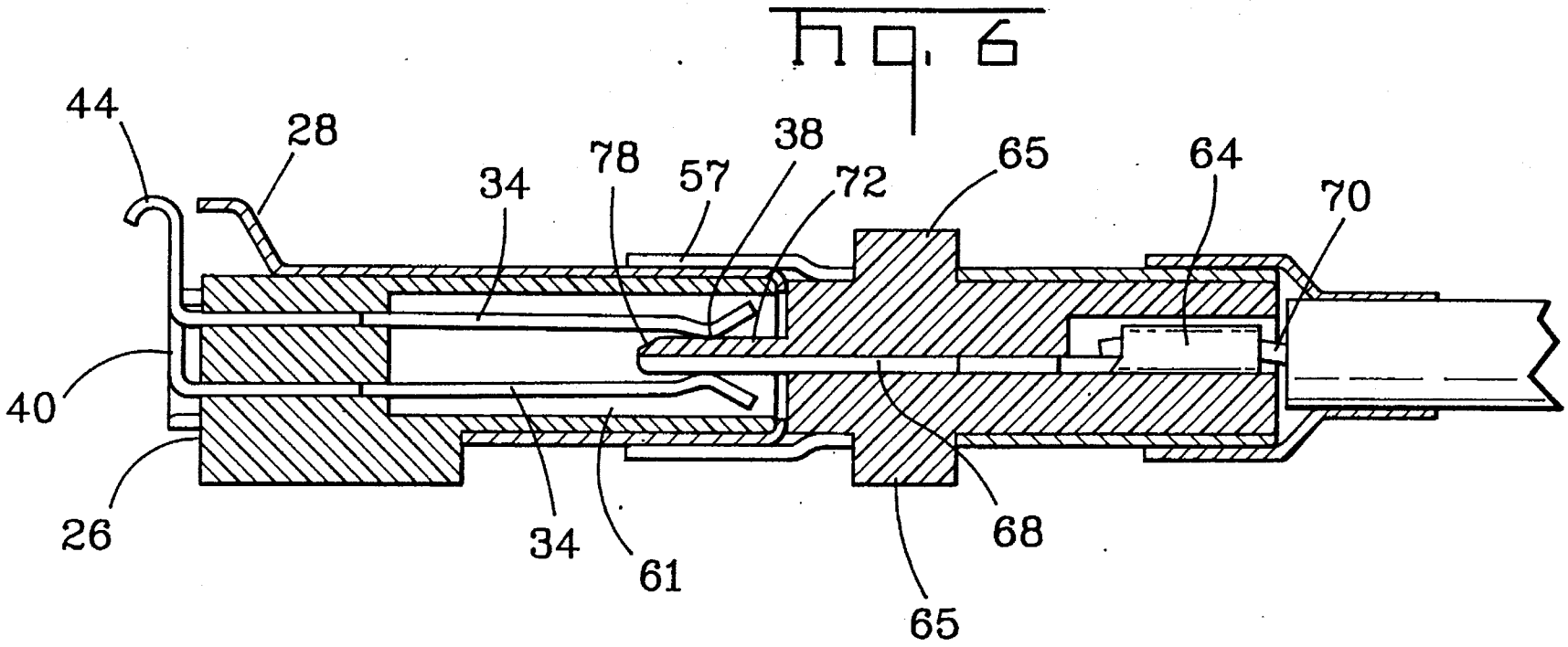
FIG. 6 is a sectional view of the assembled switch/connector of FIG. 4.

The second connector member 50, matable with connector member 20, illustrated in section at the right in FIGS. 4 and 6, comprises a grounding metal shell 52 extending between a mating end 54 and a terminated end 56. The mating end 54 is flared outward 57 to facilitate mating with connector member 20. Within said shell 52 is a dielectric insert body 58 containing a recess 60 communicating through central opening 62 with the mating end 54. Projecting radially from the insert body 58 are a pair of polarizing tabs 65. Continuity of the metal shell 52 is maintained by arranging the tabs 65 within axial slots 63.

Within recess 60 there is provided the crimping portion 64 of a stamped and formed contact 66, the body 68 of which extends through opening 62 toward the mating end 54. An external antenna conductor 70 is crimped to crimping portion 64, where the metal braided covering thereabout is suitably grounded to metal shell 52. An important facet of the connector construction is the provision of an extension 72 from the center of insert body 58 which applies a backing support to the contact end 74. Additionally, the support tip 76 is tapered 78 to facilitate a disengagement of the contact arms 34 when the respective connectors are mated in the manner illustrated in FIG. 6.

As further illustrated in FIG. 4, the mating end 54 may be segmented 80 by providing the flared end 57 with plural axial slots 63. By the flexible nature of the thin metal shell 52, the segmented end can yield if desired as the shell 22 enters into the recess 61 thereby assuring easy mating and electrical contact between the respective grounding shells 22,52.

Figure 7:
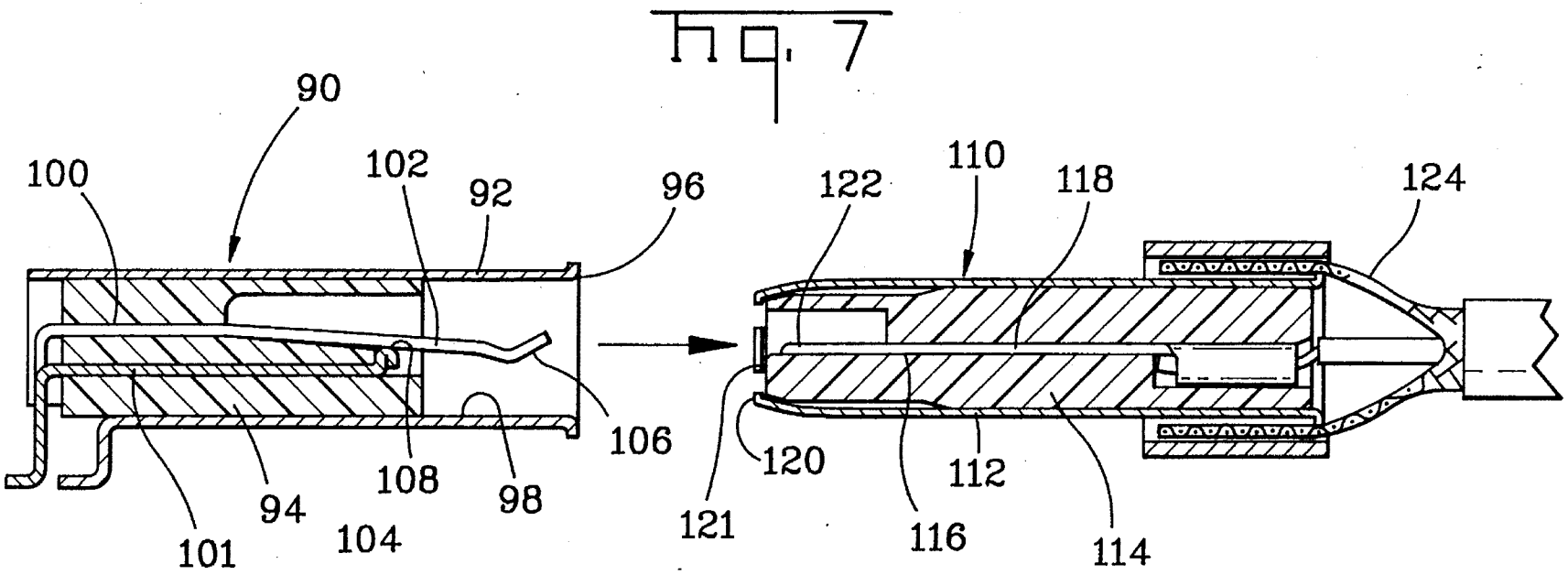
FIG. 7 is an exploded sectional view, similar to FIG. 4, showing an alternate embodiment for the switch/connector of this invention.

FIGS. 7 and 8 represent an alternate embodiment to the switch connector of FIGS. 3–6. The first connector member 90 comprises a thin metal, generally circular, grounding shell 92 containing a dielectric insert 94. The insert is recessed from flared mating end 96 to define a contact cavity 98. Communicating with cavity 98 are axial through slots 100,101 within which are contact arms 102 and 104. Contact arm 102, the longer of the two arms, projects into cavity 98 where the end 106 is arcuate shaped to provide a contact point as hereinafter discussed. The shorter contact arm 104 is fixedly secured within slot 101 throughout a major portion of its length with the end 108 bent upward in a direction toward contact arm 102. In a resiled condition, the contact end 108 electrically engages contact arm 102 to form a closed loop for a functioning internal antenna.

The second connector member 110, matable with the first connector member 90, includes a thin grounding shell 112 having a dielectric insert 114 arranged therein. The insert 114 is provided with a central opening or slot 116 to receive contact member 118. The mating end 120 of shell 112 is shown as converging toward the center to facilitate its mating with the flared end 96 of the first connector member 90. As with the preferred embodiment of FIGS. 1–5, the insert 114 has been extended at the shell mating end 120 to provide support to the end 122 of contact member 118.

To effect mating of the respective connector members 90, 110, the shell 112 of the second connector member 110 is brought into mating engagement with shell 92 of the first connector member 90, at which time the insert contact support 121 acts against contact end 106 to deflect it away from contact arm 104. Concurrently, contact member 118 electrically contacts arm 102 at the contact end point 106 thereby establishing a closed loop for the external antenna. As with the prior embodiment, the grounding path is completed by securing the metal braid 124, such as by soldering, to shell 112.

We claim:

1. An interconnection switch connector for use with apparatus for transmitting and receiving telephonic signals and containing circuitry to provide for continued electrical continuity during switching between an internal antenna and an external antenna, comprising first and second intermatable connector members, (a) said first connector member comprises a metallic shell having a dielectric insert therein, where said insert includes a central through cavity, a pair of formed, electrical, spring contact arms arranged to electrically interconnect in a resiled condition, and (b) said second connector member comprises a metallic shell having a dielectric insert therein, where said insert includes an axially extending contact support, and a central through hole for receiving a single formed contact arm having a mating end supported and stabilized against deflection by said axially extending contact support, whereby as said connector members are brought into mating engagement, with the respective shells in electrical contact, an end of said axially extending contact support engages a contact arm of said first connector member where the supported contact arm of the second connector member effects a disconnection of the contact arms of the first connector while electrically connecting with one of said contact arms.

2. The interconnection switch connector according to claim 1, wherein said first connector member includes a grounding tab extending from the metallic shell for electrically connecting to a planar conductive panel.

3. The interconnection switch connector according to claim 2, wherein one end of each said contact arm is aligned within a plane with said grounding tab to allow for the connection thereof to a common planar conductive panel.

4. The interconnection switch connector according to claim 1, wherein the mating end of each said metallic shell is configured to permit the matability of one shell to the other.

5. The interconnection switch connector according to claim 1 wherein one of the spring contact arms is fixedly mounted within the dielectric insert, while the second spring contact arm is free to flex into and out of position therewith.

6. The interconnection switch connector according to claim 5, wherein the end of the contact arm of the second connector member is axially spaced from the mating face of the insert support.

7. The interconnection switch connector according to claim 1, wherein each said connector member is housed within a respective connector housing, and that cooperative means are provided between said connector housings for mating same.

8. The interconnection switch connector according to claim 7, wherein each said connector member includes aligning and polarizing means for securing same within its respective connector housing.

* * * * *